US007312390B2

(12) United States Patent
Yanagawa et al.

(10) Patent No.: US 7,312,390 B2
(45) Date of Patent: Dec. 25, 2007

(54) AUTOMATIC MUSIC PLAYING APPARATUS AND COMPUTER PROGRAM THEREFOR

(75) Inventors: Takahiro Yanagawa, Hamamatsu (JP); Akira Suzuki, Hamamatsu (JP); Hiroyuki Torimura, Hamamatsu (JP)

(73) Assignee: Yamaha Corporation (JP)

( * ) Notice: Subject to any disclaimer, the term of this patent is extended or adjusted under 35 U.S.C. 154(b) by 270 days.

(21) Appl. No.: 10/914,608

(22) Filed: Aug. 9, 2004

(65) Prior Publication Data

US 2005/0076773 A1 Apr. 14, 2005

(30) Foreign Application Priority Data

Aug. 8, 2003 (JP) ..... 2003-289903
Apr. 28, 2004 (JP) ..... 2004-134100

(51) Int. Cl.
*G10H 1/00* (2006.01)
*G10H 1/18* (2006.01)
*G10H 7/00* (2006.01)

(52) U.S. Cl. ..... 84/615; 84/601; 84/609; 84/610; 84/611; 434/307 A

(58) Field of Classification Search ..... 84/615, 84/609, 610, 611; 434/307 A
See application file for complete search history.

(56) References Cited

U.S. PATENT DOCUMENTS 5,129,302 A * 7/1992 Nishikawa et al. ..... 84/601
5,198,603 A * 3/1993 Nishikawa et al. ..... 84/601
5,454,723 A * 10/1995 Horii ..... 434/307 A (Continued)

FOREIGN PATENT DOCUMENTS

JP 62-187397 8/1987

(Continued)

OTHER PUBLICATIONS

Relevant Portion of Japanese Office Action dated Feb. 27, 2007 issued for corresponding Japanese Patent Application No. 2004-134100.

(Continued)

*Primary Examiner*—Lincoln Donovan
*Assistant Examiner*—Christina Russell
(74) *Attorney, Agent, or Firm*—Rossi, Kimms & McDowell, LLP

(57) ABSTRACT

An external storage device stores automatic music playing data files, each file including data of a progression of musical notes constituting a performance of a music piece, and registration data files, each file including data of a set of parameters to determine the conditions for the performance of the music piece. While an automatic music playing data file of a piece of music and registration data files are loaded into a working memory and are being processed to play the current piece of music automatically, the next automatic music playing data file of the next piece of music to be played and the registration data files to be used next are prefetched from the external storage device into an internal storage device temporarily to be prepared for being transferred to the working memory for the successive automatic music playing after the automatic playing of the current music piece is over. Thus, dead time between the adjacent pieces of automatically played music and delay in effectuating the registrations will be avoided.

11 Claims, 10 Drawing Sheets

U.S. PATENT DOCUMENTS 5,530,198 A * 6/1996 Ishii ..... 84/21
5,578,778 A * 11/1996 Imaizumi ..... 84/615
5,608,178 A * 3/1997 Iwase ..... 84/609
5,698,804 A * 12/1997 Mizuno ..... 84/610
5,739,453 A * 4/1998 Chihana et al. ..... 84/615
5,747,716 A * 5/1998 Matsumoto ..... 84/609
5,880,386 A * 3/1999 Wachi et al. ..... 84/601
5,919,047 A * 7/1999 Sone ..... 434/307 A
5,990,406 A * 11/1999 Nakamura et al. ..... 84/609
5,993,220 A * 11/1999 Nakamura et al. ..... 434/307 A
6,031,175 A * 2/2000 Tozuka ..... 84/610
6,118,065 A * 9/2000 Haruyama ..... 84/609
6,166,313 A * 12/2000 Miyamoto ..... 84/477 R
6,169,243 B1 * 1/2001 Ito ..... 84/609
6,343,055 B1 * 1/2002 Ema et al. ..... 369/53.16
6,344,607 B2 * 2/2002 Cliff ..... 84/611
6,355,871 B1 * 3/2002 Yamauchi ..... 84/609
6,376,760 B1 * 4/2002 Tozuka et al. ..... 84/635
6,444,889 B1 * 9/2002 Yahata ..... 84/634
6,538,190 B1 * 3/2003 Yamada et al. ..... 84/636
6,762,355 B2 * 7/2004 Komano et al. ..... 84/477 R
6,809,248 B2 * 10/2004 Torimura ..... 84/615
6,888,999 B2 * 5/2005 Herberger et al. ..... 386/65
6,889,193 B2 * 5/2005 McLean ..... 704/500
6,911,924 B2 * 6/2005 Kurachi et al. ..... 341/120
6,933,432 B2 * 8/2005 Shteyn et al. ..... 84/609
7,015,388 B2 * 3/2006 Taruguchi ..... 84/609
7,189,911 B2 * 3/2007 Isozaki ..... 84/609
2001/0007221 A1 * 7/2001 Uehara ..... 84/649
2002/0002411 A1 * 1/2002 Higurashi et al. ..... 700/91
2002/0134222 A1 * 9/2002 Tamura ..... 84/622
2002/0178898 A1 * 12/2002 Hagiwara et al. ..... 84/664
2003/0024376 A1 * 2/2003 Gyoten et al. ..... 84/609
2003/0131716 A1 * 7/2003 Aoki et al. ..... 84/610
2003/0131719 A1 * 7/2003 Kubita ..... 84/615
2003/0167905 A1 * 9/2003 Muramatsu et al. ..... 84/610
2003/0210617 A1 * 11/2003 Millikan et al. ..... 369/30.23
2004/0144236 A1 * 7/2004 Hiratsuka ..... 84/609
2006/0060066 A1 * 3/2006 Komano et al. ..... 84/609

FOREIGN PATENT DOCUMENTS

JP 3-155595 A 7/1991
JP 6-195066 A 7/1994
JP 10-31493 A 2/1998
JP 10-228292 A 8/1998
JP 11-73185 A 3/1999
JP 2910833 B2 4/1999
JP 2002-258861 A 9/2002
JP 2002-341864 A 11/2002
JP 2003-58192 A 2/2003

OTHER PUBLICATIONS

Japanese Office Action with a mail date of Jul. 10, 2007 issued for corresponding Japanese Patent Application No. 2004-134100.

* cited by examiner

*Fig. 2* Main Routine Flow
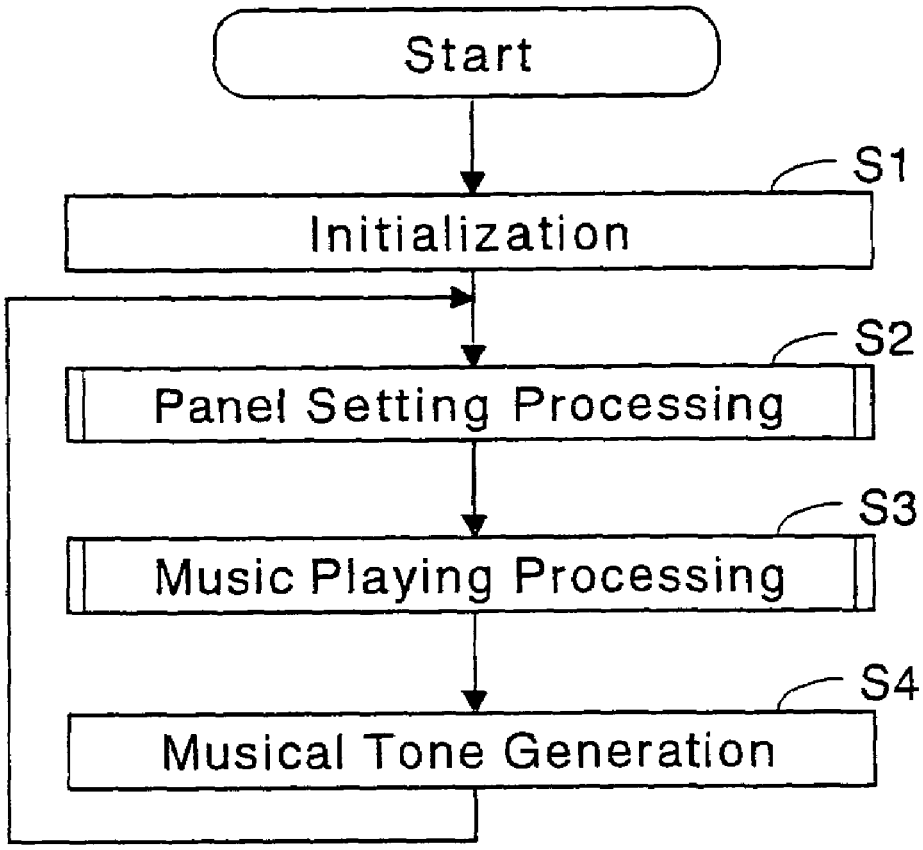

*Fig. 3a* Panel Setting Processing (Part 1)
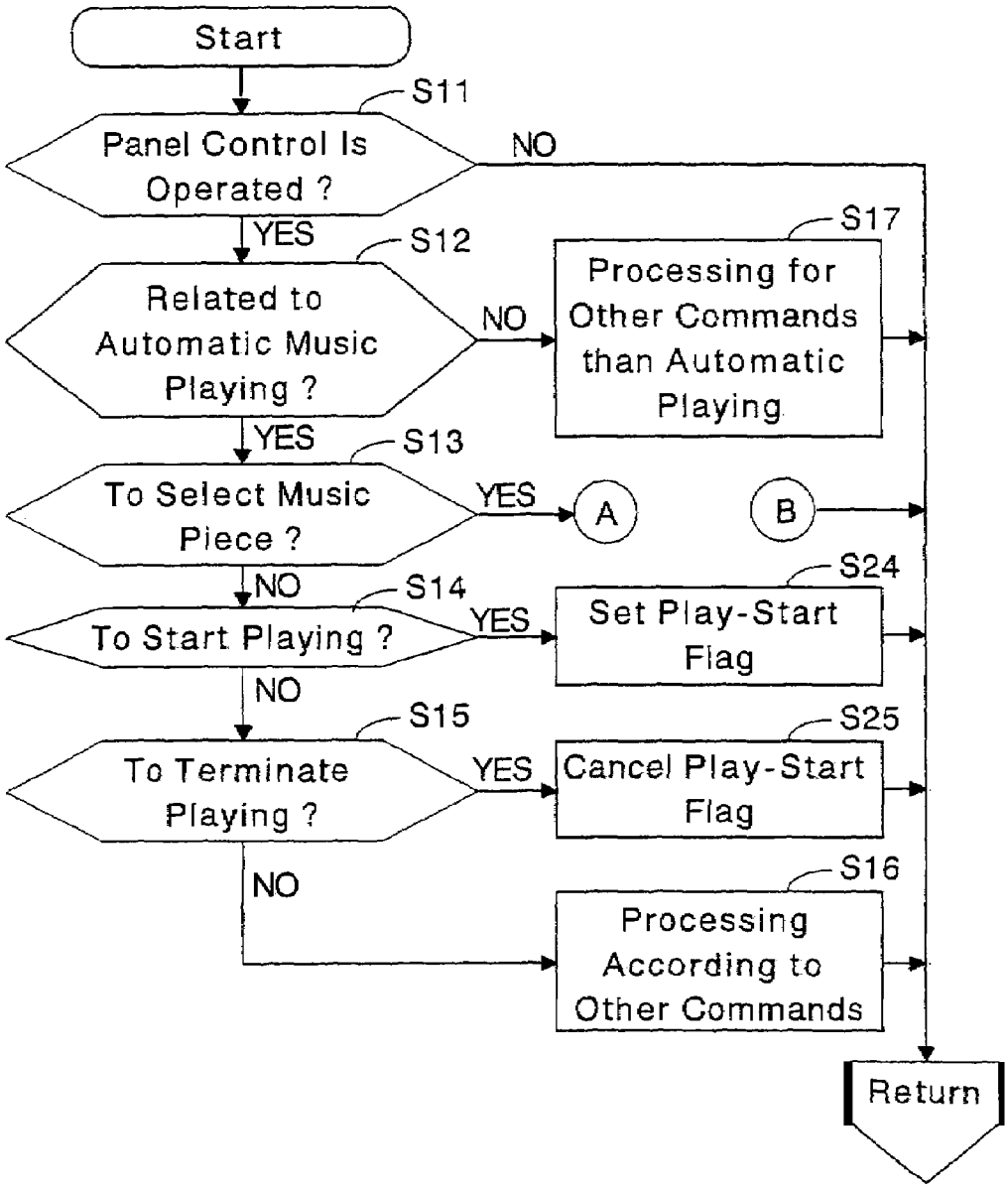

*Fig. 3b* Panel Setting Processing (Part 2)
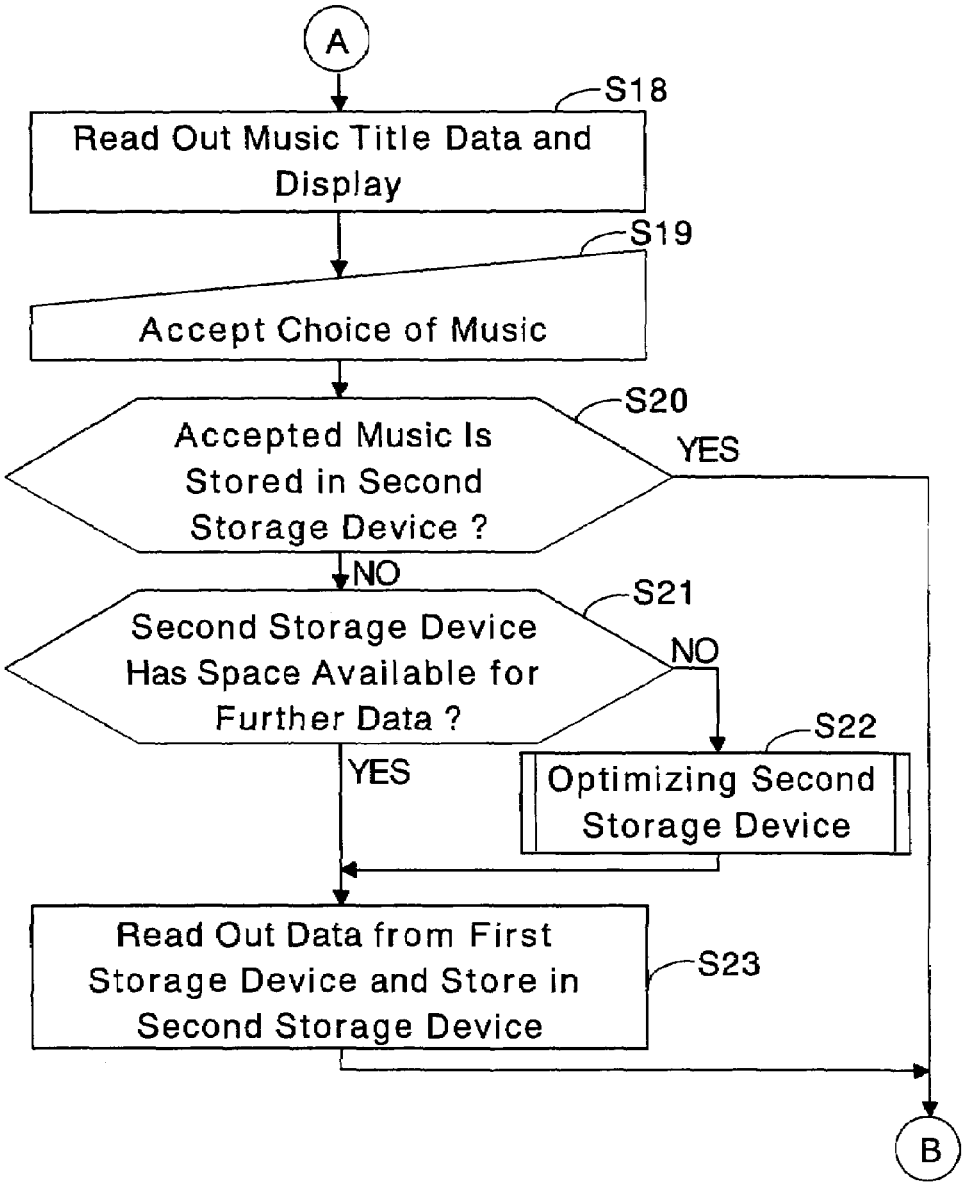

*Fig. 4a* Music Playing Processing (Part 1)
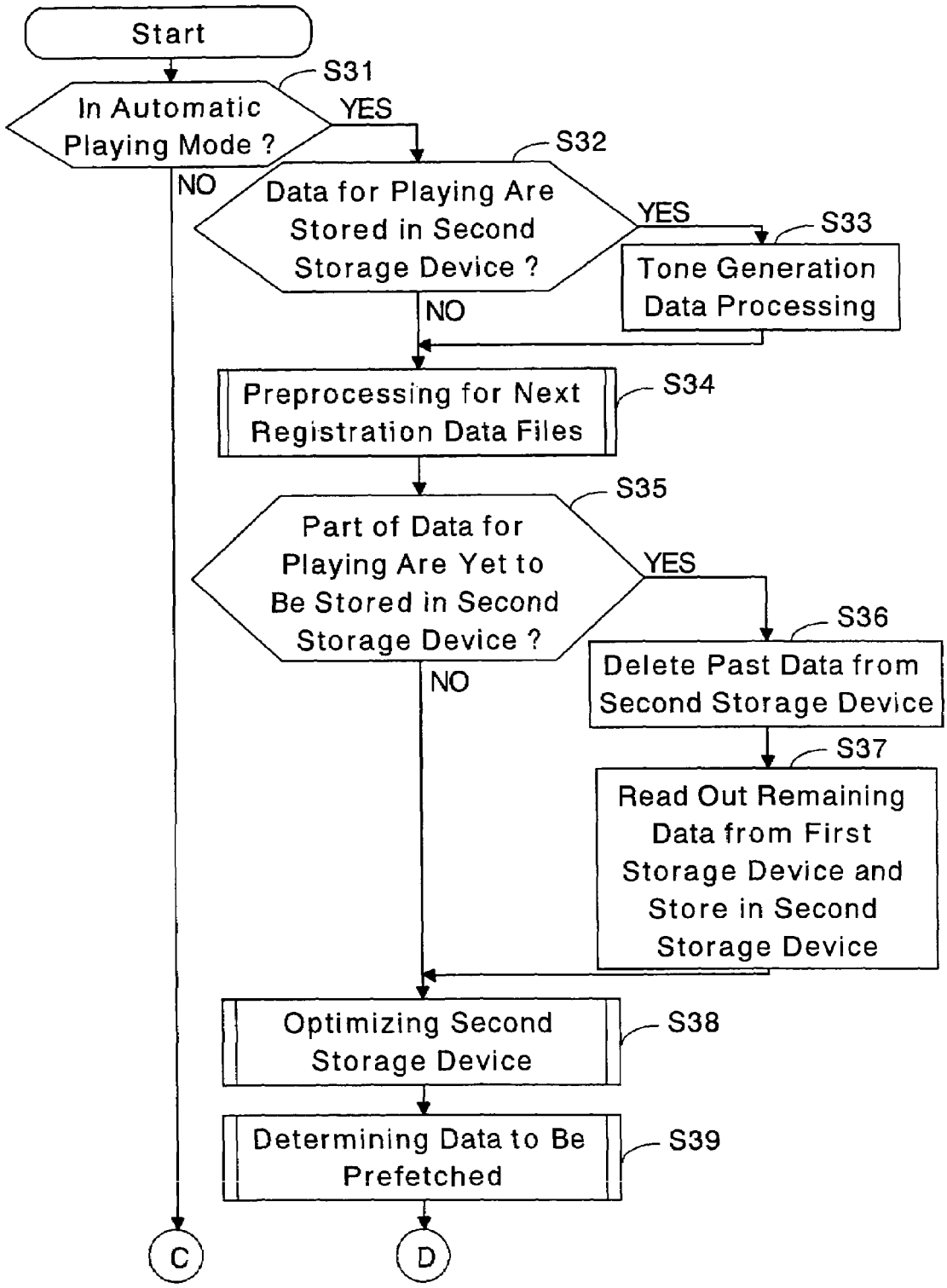

*Fig. 4b* Music Playing Processing (Part 2)
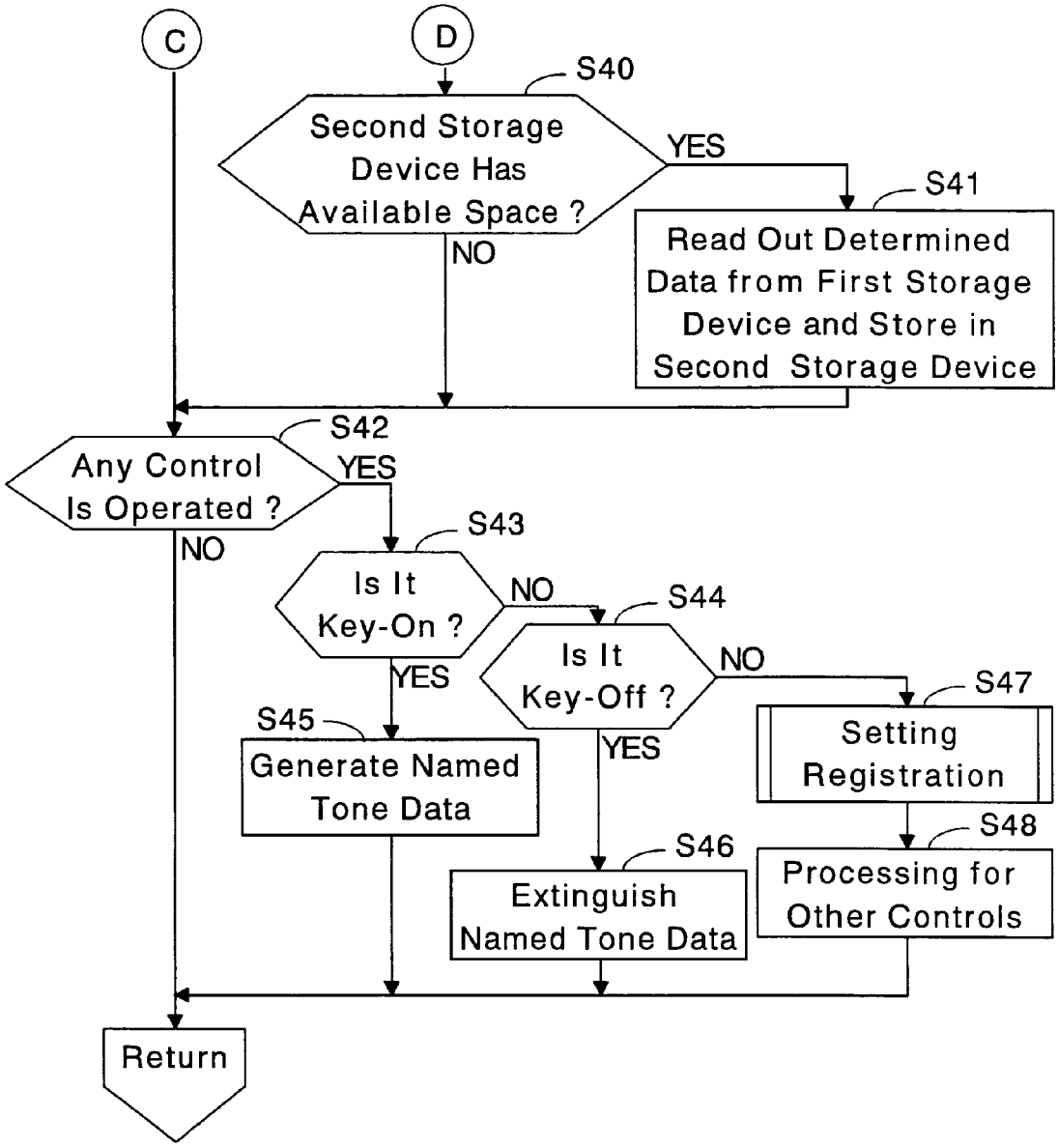

*Fig. 5* Optimizing Second Storage Device
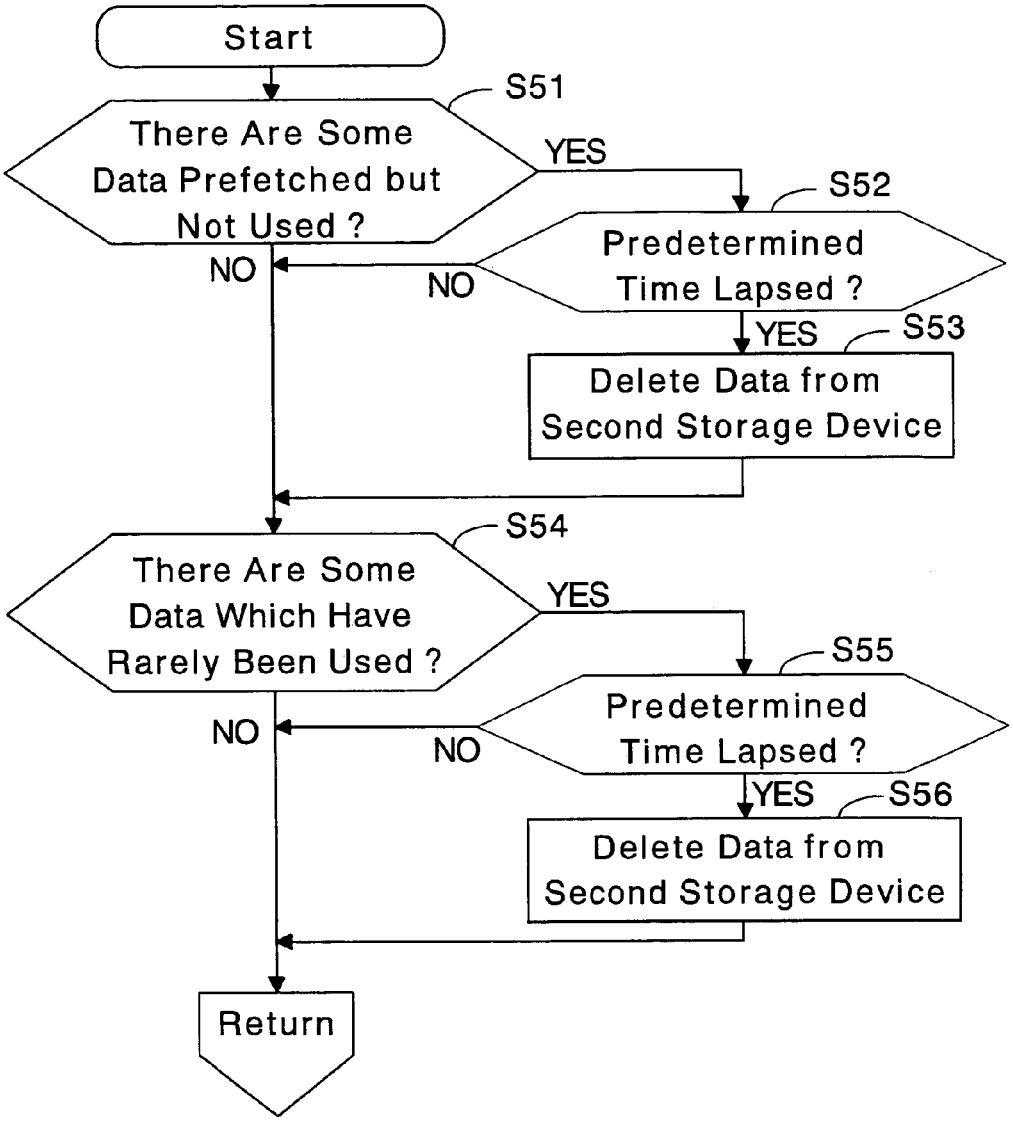

Determining Data to Be Prefetched

*Fig. 7* Preprocessing for Next Registration Data Files
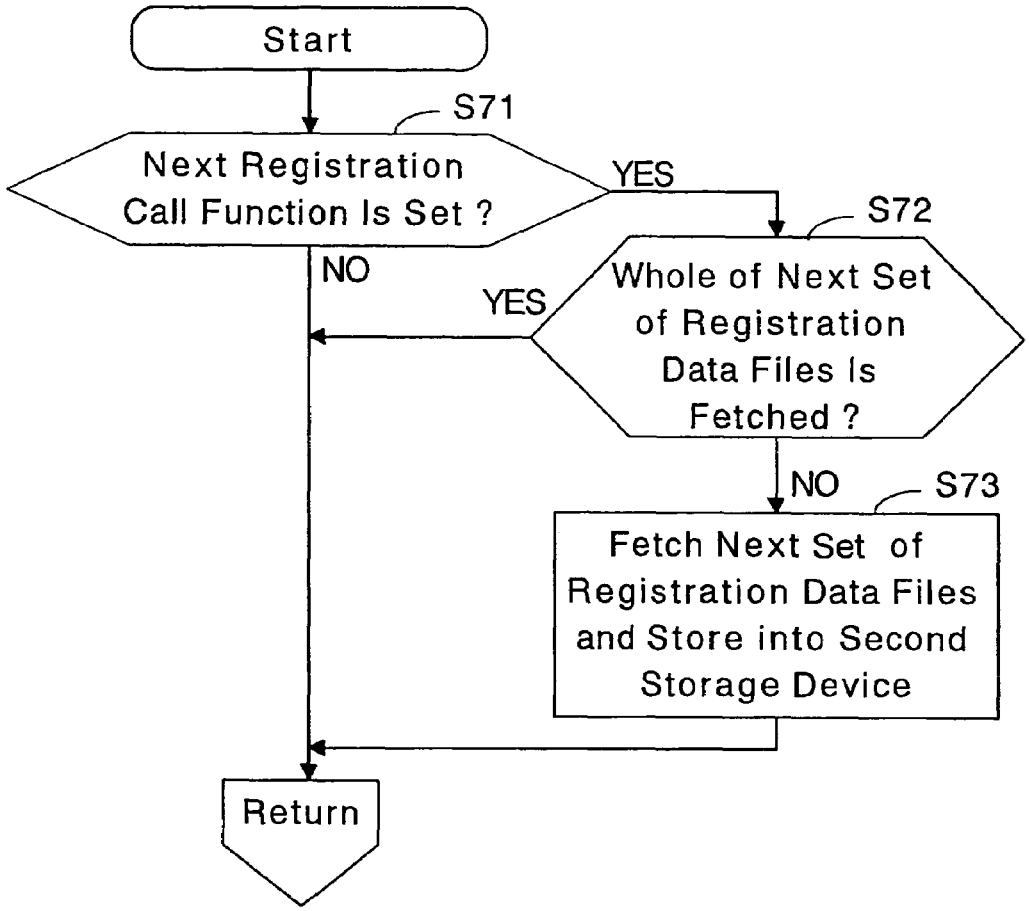

*Fig. 8* Setting Registration
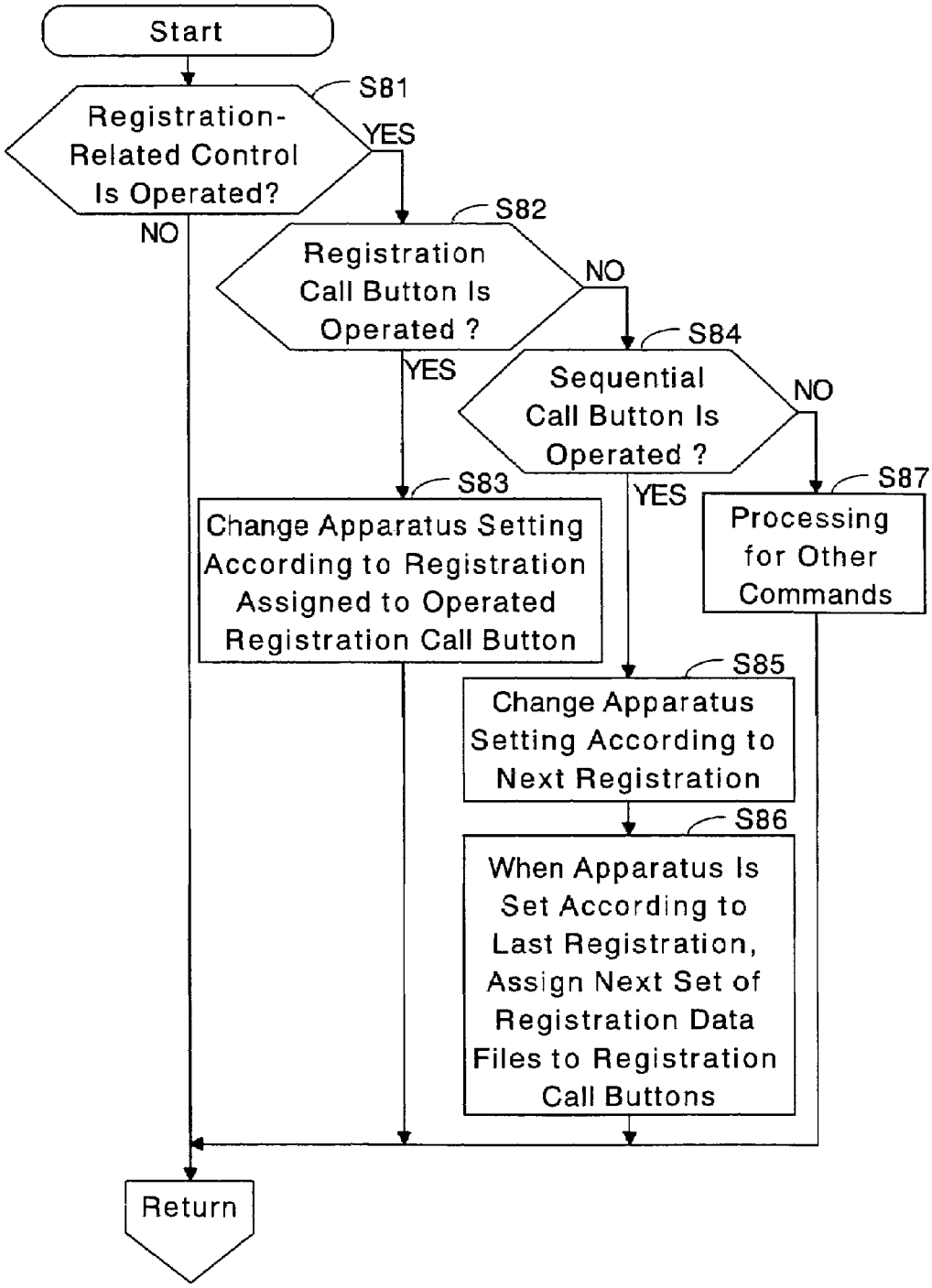

AUTOMATIC MUSIC PLAYING APPARATUS AND COMPUTER PROGRAM THEREFOR

TECHNICAL FIELD

The present invention relates to an automatic music playing apparatus and a computer program therefor, and more particularly to an automatic music playing apparatus of a data processing type and a computer program therefor, in which an automatic music playing is conducted according to a music playing data file stored in an external storage device and fetched therefrom, and in which during an automatic playing of a current music piece, the data for an automatic playing of a music piece to be played next are prefetched into a secondary memory device so that the automatic playing of the next music piece will be started soon after the automatic playing of the current music piece comes to an end. In addition to the music playing data files containing the note progression data of music pieces, registration data files defining various settings of the parameters for the music playing are also stored in the external storage device to be fetched and used in playing music.

BACKGROUND

Various types of automatic music playing apparatuses are known in the art, with which musical tones are generated based on a musical performance data file to give an automatic musical performance. An example of such automatic music playing apparatuses is one which stores many data files of music pieces and automatically plays those music pieces successively. See Japanese patent No. 2,910,833. In such an automatic music playing apparatus, the order of the music pieces to be automatically played are previously set by the user or by default, and the music pieces are automatically played one after another accordingly. Some apparatuses further store lots of registration data (i.e. data setting various parameters for a performance) and play the music pieces by properly changing the apparatus setting of controlling the parameters for the performance, accordingly. See unexamined Japanese patent publication No. S62-187397. More particularly, a multiplicity of registration data sets, each set consisting of a combination of plural performance controlling parameters with respect to musical tone generation such as the timbre (voice) and the rhythm utilized in conducting a performance, are previously assigned to predetermined manipulating controls such as buttons and switches, so that the user will manipulate such a button or a switch to set the parameters in a lump and the apparatus will conduct an automatic playing of the music based on such set parameters. The order in which the registration data are utilized may be designated by the user's previous setting or by the default setting.

In a conventional automatic music playing apparatus as mentioned above, the automatic musical performance data and the registration data are stored in an external storage medium such as a semiconductor memory, and these data can be arbitrarily read out from the storage medium into the working memory to be used for playing music automatically. In such a conventional automatic music playing apparatus, however, when a plurality of music pieces are played automatically in a predetermined order of the music pieces, the automatic music playing data file for the music piece to be played next can be read out only after the currently playing music piece comes to an end. More specifically, it takes time to read out a data file of automatic playing of a music piece stored in an external storage device, and accordingly there will be unnecessary dead time between the end of playing a music piece and the start of playing the next music piece. Further, in case the order of the music pieces to be played are not previously set, the user has to designate a music piece to be played next properly during the automatic playing of the current music piece. Otherwise, the automatic successive playing of a plurality of music pieces will be interrupted inconveniently. On the other hand, with an automatic music playing apparatus which permits changes in registration during the automatic playing of a music piece, it will take time to read out a necessary registration data set from an external storage medium, even where plural registrations, i.e. plural sets or combinations of parameters, are previously set and assigned to the switches or the like according to the order of use, and thus it is hard to reflect a new registration to the playing immediately when it is intended. This is because the automatic performance data set and the registration data set are read out from the external storage medium every time and only when they are required, and the data sets which will be required later in the order of music pieces to be played or in the order of registrations to be used are not read out beforehand. Thus, the times required for reading out various necessary data sets from the external storage device will deteriorate the consecutive automatic music playing, which is a disadvantageous problem in the conventional apparatus.

SUMMARY OF THE INVENTION

It is, therefore, a primary object of the present invention to solve the drawbacks with the conventional apparatus, and to provide a novel type of automatic music playing apparatus and computer program therefor, in which an automatic music playing data set of the music piece to be played next to the music piece being currently played or a registration data set to be used at the time of the next registration change of the apparatus are prefetched from an external storage medium so that a plurality of music pieces will be played automatically without unnecessary dead times between the music pieces played successively or that a necessary change in registration will be reflected in the automatic playing at every required time.

According to the present invention, the object is accomplished by providing an automatic music playing apparatus comprising: a first storage device which stores a plurality of automatic music playing data files; a second storage device which temporarily stores an automatic music playing data file to be subject to automatic music playing processing; a transfer device which fetches an automatic music playing data file from the first storage device and transfers the fetched automatic music playing data file to the second storage device; manual music playing controls to be manipulated by a user for manual music playing; a music playing processing device which reads out from the second storage device the automatic music playing data file to be subject to automatic music playing processing, conducts automatic music playing processing according to the automatic music playing data file read out from the second storage device, and conducts manual music playing processing based on the manipulation by the user of the manual music playing controls; and a transfer controlling device which controls the transfer device to read out from the first storage device at least a part of another automatic music playing data file than the automatic music playing data file according to which the automatic music playing is currently being conducted, and to transfer the at least a part of the other automatic music playing data file to the second storage device, during the time when the music playing processing device is conducting the current automatic music playing processing.

For example, an external storage device stores a plurality of automatic music playing data files, each file including data of a progression of musical notes constituting a performance of a music piece. While an automatic music playing data file of a piece of music is loaded into a working memory and is being processed to play the current piece of music automatically, the next automatic music playing data file of the next piece of music to be played is prefetched from the external storage device into an internal storage device temporarily to be prepared for being transferred to the working memory for the successive automatic music playing after the automatic playing of the current music piece is over. Thus, dead time between the adjacent pieces of automatically played music will be avoided.

According to the present invention, the object is further accomplished by providing a music playing apparatus comprising: a plurality of registration call buttons; a first storage device which stores registration data files each defining a set of parameters for a musical performance conducted by the music playing apparatus; a second storage device which temporarily stores registration data files; a transfer device which fetches a sub-plurality of registration data files from the first storage device and transfers the fetched sub-plurality of registration data files to the second storage device; a registration assignment device which assigns the sub-plurality of registration data files in the second storage device respectively to the registration call buttons; a music playing processing device which reads out from the second storage device a registration data file which is assigned to a manipulated one of the plurality of registration call buttons in response to the manipulation of the manipulated one, sets the parameters for music playing, and conducts music playing processing using the set parameters; and a transfer controlling device which controls the transfer device to read out from the first storage device another registration data file than the sub-plurality of registration data files respectively assigned to the plurality of assignment call buttons, and to transfer the other registration data file to the second storage device, during the time when the plurality of registration call buttons are assigned with the respective registration data files.

For example, an external storage device stores registration data files, each file including data of a set of parameters or a combination of registers to determine the conditions for the performance of a music piece to be played. While the registration data files are loaded into a working memory and are currently used for determining the conditions for playing a piece of music, the registration data files to be used next are prefetched from the external storage device into an internal storage device temporarily to be prepared for being transferred to the working memory for the successive use after the preceding loaded registration data files have been used for the playing of the music piece. Thus, undesirable delay in effectuating the respective registrations will be avoided.

According to the present invention, the object is still further accomplished by providing a music playing apparatus comprising: a plurality of registration call buttons; a first storage device which stores registration data files each defining a set of parameters for music playing conducted by the music playing apparatus; a second storage device which temporarily stores registration data files; a transfer device which fetches a sub-plurality of registration data files from the first storage device and transfers the fetched sub-plurality of registration data files to the second storage device; a registration assignment device which assigns the sub-plurality of registration data files in the second storage device respectively to the registration call buttons; a sequential call button; a music performance processing device which calls one after another of the plurality of registration call buttons in a predetermined order of sequence to read out from the second storage device the registration data file which is assigned to the called one of the plurality of registration call buttons upon manipulation of the sequential call button, sets the parameters for music playing according to the registration data file which is assigned to the called registration call button, and conducts music playing processing using the set parameters; and a transfer controlling device which controls the transfer device to read out from the first storage device another registration data file than the sub-plurality of registration data files respectively assigned to the plurality of registration call buttons, and to transfer the other registration data file to the second storage device, during the time when the plurality of assignment call buttons are assigned with respective registration data files. Thus, the registrations may be changed over from one to another by a simple operation of the sequential call button. The sequential call button may be a foot-operated button.

According to the present invention, the object is still further accomplished by providing a computer program for playing music automatically containing program instructions executable by a computer, the program causing the computer to execute: a first data storing step of storing a plurality of automatic music playing data files in a first storage device; a second data storing step of temporarily storing an automatic music playing data file in a second storage device to be subject to automatic music playing processing; a transferring step of fetching an automatic music playing data file from the first storage device and transferring the fetched automatic music playing data file to the second storage device; a step of providing manual music playing controls to be manipulated by a user for manual music playing; a step of reading out from the second storage device the automatic music playing data file to be subject to automatic music playing processing; a step of conducting automatic music playing processing according to the automatic music playing data file read out from the second storage device; a step of conducting manual music playing processing based on the manipulation by the user of the manual music playing controls; and a step of controlling the transferring step to read out from the first storage device at least a part of another automatic music playing data file than the automatic music playing data file according to which the automatic music playing is currently being conducted, and to transfer the at least a part of the other automatic music playing data file to the second storage device, during the time when the step of conducting automatic music playing processing is conducting the current automatic music playing processing.

According to the present invention, the object is still further accomplished by providing a computer program for playing music containing program instructions executable by a computer, the program causing the computer to execute: a step of providing a plurality of registration call buttons; a first data storing step of storing registration data files in a first storage device, each registration data file defining a set of parameters which determine the conditions for playing music; a second data storing step of temporarily storing registration data files in a second storage device; a transferring step of fetching a sub-plurality of registration data files from the first storage device and transferring the fetched sub-plurality of registration data files to the second storage device; a registration assignment step of assigning the sub-plurality of registration data files in the second storage device respectively to the registration call buttons; a step of reading out from the second storage device the registration data file which is assigned to a manipulated one of the plurality of registration call buttons in response to the manipulation of the manipulated one; a step of setting the parameters for music playing; a step of conducting music playing processing using the set parameters; and a step of controlling the transferring step to read out from the first storage device another registration data file than the sub-plurality of registration data files respectively assigned to the plurality of assignment call buttons, and to transfer the other registration data file to the second storage device, during the time when the plurality of assignment call buttons are assigned with respective registration data files.

According to the present invention, the object is still further accomplished by providing a computer program for playing music containing program instructions executable by a computer, the program causing the computer to execute: a step of providing a plurality of registration call buttons; a first data storing step of storing registration data files in a first storage device, each registration data file defining a set of parameters which determine the conditions for playing music; a second data storing step of temporarily storing registration data files in a second storage device; a transferring step of fetching a sub-plurality of registration data files from the first storage device and transferring the fetched sub-plurality of registration data files to the second storage device; a registration assignment step of assigning the sub-plurality of registration data files in the second storage device respectively to the registration call buttons; a step of providing a sequential call button; a step of calling one after another of the plurality of assignment call buttons in a predetermined order of sequence to read out from the second storage device the registration data file which is assigned to the called one of the plurality of registration call buttons upon manipulation of the sequential call button; a step of setting the parameters for music playing according to the registration data file which is assigned to the called registration call button; a step of conducting music playing processing using the set parameters; and a step of controlling the transferring step to read out from the first storage device another registration data file than the sub-plurality of registration data files respectively assigned to the plurality of registration call buttons, and to transfer the other registration data file to the second storage device, during the time when the plurality of registration call buttons are assigned with respective registration data files.

As will be apparent from the description herein later, some of the structural element devices of the present invention are structured by means of hardware circuits, while some are configured by a computer system performing the assigned functions according to the associated programs. The former may of course be configured by a computer system and the latter may of course be hardware structured discrete devices. Therefore, a hardware-structured device performing a certain function and a computer-configured arrangement performing the same function should be considered a same-named device or an equivalent to each other.

BRIEF DESCRIPTION OF THE DRAWINGS

For a better understanding of the present invention, and to show how the same may be practiced and will work, reference will now be made, by way of example, to the accompanying drawings, in which:

FIG. 2 is a flow chart describing an example of the main routine of the overall processing according to the present invention;

FIGS. 3*a* and 3*b* are, in combination, a flow chart describing an example of the panel setting processing according to the present invention;

FIGS. 4*a* and 4*b* are, in combination, a flow chart describing an example of the music playing processing according to the present invention;

FIG. 5 is a flow chart describing an example of the process for optimizing the second storage device;

FIG. 7 is a flow chart describing an example of the process for preparing the next registration; and FIG. 8 is a flow chart describing an example of the process for setting a registration.

DETAILED DESCRIPTION OF THE PREFERRED EMBODIMENTS OF THE INVENTION

Figure 1:
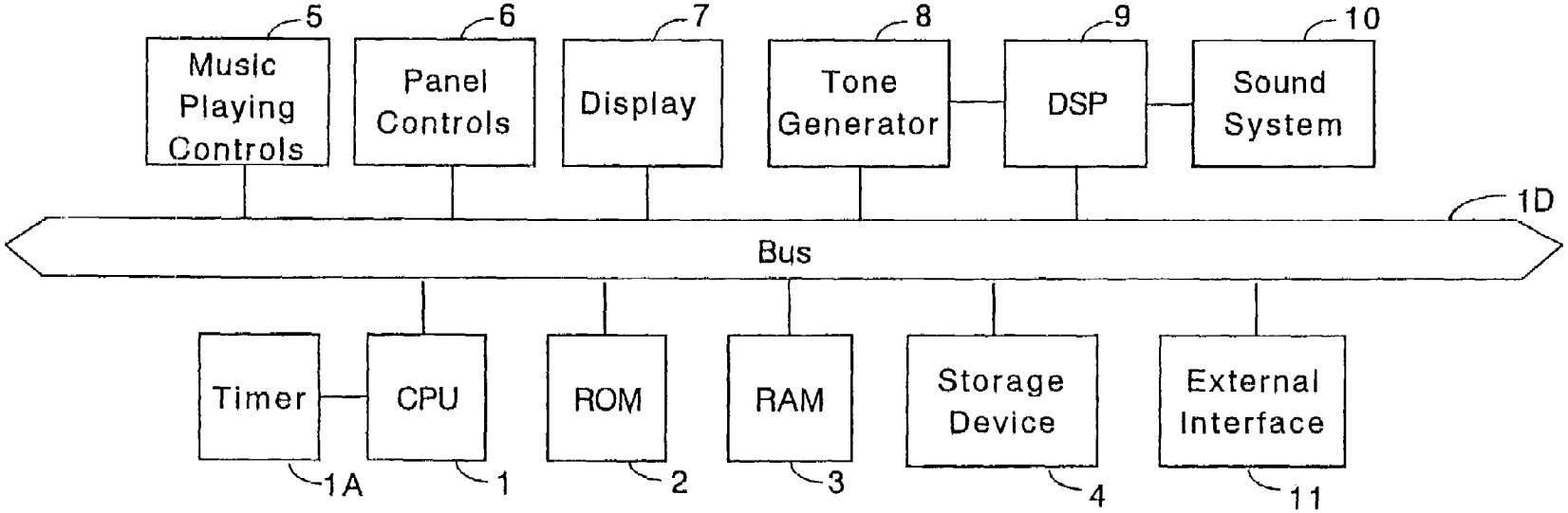
FIG. 1 is a block diagram illustrating the hardware configuration of an embodiment of an electronic musical instrument incorporating an automatic music playing apparatus according to the present invention.

Herein below will be described an embodiment of the present invention with reference to accompanying drawings. FIG. 1 shows a block diagram illustrating the hardware configuration of an embodiment of an electronic musical instrument incorporating an automatic music playing apparatus according to the present invention. In the present embodiment, the operations of the apparatus are conducted under the control of a microcomputer comprising a microprocessor or central processing unit (CPU) 1, a read-only memory (ROM) 2 and a-random-access memory (RAM) 3. The illustrated electronic musical instrument is controlled by the single CPU 1.

The CPU 1 controls the overall operations of this electronic musical instrument. The CPU 1 is connected, via a communication bus (including data bus and address bus) 1D, to the ROM 2, the RAM 3, a storage device 4, music playing controls 5, panel controls 6, a display device 7, a tone generator 8, a digital signal processor (DSP) 9 and an external interface 11. The CPU 1 is further connected to a timer 1A which controls the interruption timing of timer interrupt processing and counts various times in operation. Namely, the timer 1A generates a tempo clock pulse for counting musical time periods and for setting a music playing tempo when an automatic music playing is conducted according to automatic music playing data. The frequency of the tempo clock pulse is adjustable by means of, for example, a tempo setting control or switch among the panel controls 6. The tempo clock pulse thus generated from the timer 1A is supplied to the CPU 1 in the form of process time instructions and interrupt instructions. The CPU 1 conducts various processing including main routine processing (as will be described with reference to FIG. 2 later) according to these instructions.

The ROM 2 stores various control programs to be executed or referenced by the CPU 1 and various data including a plurality of sets of apparatus setting data pieces (i.e. sets of parameters, each set containing various control parameters which determine the conditions of tone generation for the music playing, and being also termed as "a registration data file" representing a combination of registers) which are assigned to the respective ones of later-described registration call buttons. The RAM 3 is used as a memory which stores automatic music playing data and registration data being currently used, a working memory which temporarily stores various data processed or produced while the CPU 1 executes the programs, and a memory which stores the currently running programs and the associated data. The predetermined address areas of the RAM 3 are allotted for those respective functions, and are used for registers, flags, tables, memories, etc. Further, in the present embodiment, some areas of the RAM 3 are used as a second storage device of the present invention for temporarily storing a music playing data file and registration data files prefetched from the storage device 4 or first storage device of the present invention. The registration data file contains the parameters for controlling the music playing such as the voice control parameters which control the voices (timbres) of the music playing, the effect control parameters which control the effects to be imparted to the tones of the music playing and the accompaniment-on parameter which controls whether an accompaniment is to be given.

The storage device 4 is the first storage device, for example, equipped with an external storage medium, and stores the automatic music playing data files each of which contains data of a progression of musical notes constituting a performance of a music piece, the registration data files each of which contains a set of control parameters to determine the conditions of the automatic music playing, and the various control programs to be executed by the CPU 1. In the case where the ROM 2 does not store the control programs or the registration data files, such control programs or registration data files may be stored in the storage device 4 and may be transferred to the RAM 3 so that the CPU 1 can operate in the same way as the case where the ROM 2 stores the control programs and the registration data files. This situation will be rather advantageous in that the control programs and the registration data files can be easily up-graded or added. Where the storage device 4 stores the registration data files, a set of plural registration data files may be stored in connection with one automatic music playing data file for one piece of music, wherein each registration data file contains a combination of plural registration data pieces representing a combination of parameters to determine the conditions of playing the piece of music. The number of registration data files in the set corresponds to the number of registration call devices, for example call buttons, each of which enables the setting of the combination of plural parameters by one push according to the registration data assigned thereto, as will be described later. For example, where there are sixteen registration call buttons prepared, sixteen different registrations can be assigned and called by one push. Further, plural sets of registration data files may be prepared for one piece of music. And, the order of use of these stored registration data files may be previously set. The storage device 4 may be any type of storage device using any of various external storage media such as a flexible disk (FD), a compact disk (CD), a magneto-optical (MO) disk or a digital versatile disk (DVD). Alternatively, the storage device 4 may be a semiconductor memory or a hard disk drive (HDD).

The music playing controls 5 are such controls manipulated by the user as the manual keys of a musical keyboard and the pedal keys of a pedal keyboard of the musical instrument for selecting notes in playing music, each key having a key switch for the detection of manipulation. Although the keys are provided for the manual and pedal playing of music, they may be also used for inputting other control commands. One of the pedal controls may be set such that it can be used as a sequential call button for sequentially calling the assignment call buttons one after another to sequentially render a registration data file assigned to each registration call button effective. Thus, the user can easily switch over the registrations one after another by simply manipulating the pedal control at any intended time in the midst of music playing, in place of manipulating the registration call buttons using a hand. The sequential call button may be a dedicated foot-operated button rather than the above described pedal key.

The panel controls 6 are controls for setting various conditions for the apparatus and includes various manipulating controls such as a music piece selecting switch for selecting a music piece to be played automatically, a music playing start/stop switch for commanding the start or the stop of the automatic music playing, parameter setting switches for individually setting various control parameters including voices (timbres) and rhythms for the music playing. In the present embodiment, there are provided a plurality of registration call buttons, and each registration call button is assigned with a registration data file representing a combination of plural parameters which determine the conditions of the music playing. Thus, the user can set the plural parameters in a lump by manipulating a registration call button, according to the assigned registration data file. In conducting the automatic music playing using a desired automatic music playing data file, the user can switch over the settings of the parameters arbitrarily by manipulating the registration call buttons. The panel controls 6 may further include a ten-key pad or an alphanumeric keyboard for inputting numeric data or character data for selecting, setting or controlling the note pitches, the timbres, effects, etc., or analog value adjusters such as a pitch bend wheel or slider for setting the pitch bend amount according to the amount of manipulation. As the manipulated conditions of the respective panel controls are detected, the detected control data are transferred to the CPU 1 via the data bus 1D. The display device 7 includes, for example, a liquid crystal display (LCD) panel or a CRT, and displays the information about the music piece such as the title and the artist name, the current set conditions of the music playing control parameters, the current playing state of the automatic music playing, the current registration, and the operating conditions of the CPU 1. Alternatively, the registration call button may not necessarily be provided among the panel controls 6, but may be other dedicated call buttons or switches or else provided separately from the panel controls 6.

The tone generator 8 is of a multi-channel processing type and is capable of generating plural tone signals simultaneously, and receives the automatic music playing data via the bus 1D or the music playing data produced according to the user's manipulation of the music playing controls 5 to generate musical tones based on such received music playing data. The musical tone signals generated by the tone generator 8 are passed through the DSP 9 for the predetermined digital signal processing, and the processed tone signals are supplied to the sound system 10 which includes an amplifier and a loudspeaker to be emitted as audible sounds. Although not shown in FIG. 1, an effect circuit may be inserted in the path between the tone generator 8 and the sound system 10 to impart various sound effects to the tone signals from the tone generator 8. Any conventionally known structure may be employed for the tone generator 8, the DSP 9, the sound system 10, (and also the effect circuit. For example, the tone generator 8 may employ any type of tone synthesizing method such as an FM synthesis, a PCM synthesis, a physical model synthesis and a formant synthesis. The tone generator 8 may be configured in the form of a dedicated hardware structure, or of a software processing by the CPU 1.

The external interface 11 is for receiving and transmitting various data signals including automatic music playing data files between the electronic musical instrument of FIG. 1 and an external apparatus (not shown), and may be a MIDI interface or a communication interface. The MIDI interface is an interface for inputting MIDI event data signals (of the MIDI protocol) from an external MIDI apparatus to this electronic musical instrument and outputting MIDI data signals from this electronic musical instrument to another MIDI apparatus. The other MIDI apparatus may be any type of apparatus capable of generating data signals of the MIDI protocol according to the user's manipulation such as a keyboard type, a guitar type, a wind instrument type, a percussion instrument type, a body movement detection type, or else. A communication interface may be further provided for connecting to a wired or a radio communication network such as a LAN, Internet, and a telephone line to access a networked apparatus such as a personal computer and a server computer for fetching automatic music playing data files provided in such a networked apparatus into this electronic musical instrument. The communication network will be further used to download various programs and various data files from a server computer in the communication network into this electronic musical instrument. The communication interface may be of either a wired type or a radio type or both.

In the case where the external interface is formed by a MIDI interface, the MIDI interface may not necessarily be a dedicated MIDI interface, but also may be formed by using a general-purpose interface such as an RS232-C, a USB (universal serial bus) and an IEEE1394. In such a case, other data than MIDI event data can be received and transmitted concurrently. Where such a general-purpose interface as mentioned above is used as the MIDI interface, the other MIDI apparatuses may be so designed as to receive and transmit other data than MIDI event data. The data format may, of course, be of other protocols than the MIDI protocol, wherein the MIDI interface and the other MIDI apparatuses will be adapted for such data processing accordingly.

An electronic musical instrument incorporating an automatic music playing apparatus according to the present invention may not necessarily have built-in panel controls 6, a built-in display device 6 and a built-in tone generator, but may be configured by connecting separate such devices interconnected with each other by an external interface, various networks or other communication means. Further, an automatic music playing apparatus of the present invention can be applied to any kind of apparatuses including an electronic musical instrument, a personal computer, a portable communication terminal such as a PDA (personal digital assistant) and a cellular phone, a karaoke apparatus, and a game machine. In case of a portable communication terminal, the terminal itself may not necessarily perform the necessary functions, but a server may perform a part of the necessary functions so that the necessary functions are performed by the whole system including the terminal and the server.

The computer operated electronic musical instrument of FIG. 1 is capable of presenting both a manual music playing with the electronically generated musical tones according to the user's manipulation of the music playing controls 5 and an automatic music playing (or accompaniment playing) with the electronically generated musical tones according to the automatic music playing data file stored, for example, in the storage device 4. And further, the simultaneous presentation of an automatic music playing based on the automatic music playing data and a manual music playing based on the manipulation of the music playing controls by the user is, of course, possible. The operation will be first described about the main routine processing for such functions with reference to FIG. 2. FIG. 2 shows a flow chart describing an example of the main routine of the overall processing conducted in the electronic musical instrument of FIG. 1. The main routine processing covers panel setting processing for rendering the automatic music playing system operative and music playing processing for generating musical tones. Detailed operations of the embodiment for those processing will be described herein below with reference to FIG. 2. The main routine is the process routine which is initiated at the power-on of the electronic musical instrument and is kept running until the power-off of the same.

A step S1 is the initialization of the system. The initialization covers, for example, a process of deleting automatic music playing data, etc. stored in the RAM 3 (a second storage device), and a process of clearing various settings remaining in the electronic musical instrument. A step S2 conducts panel setting processing, which will be described in detail herein later with reference to FIG. 3. In short, however, the panel setting processing is to obtain data with respect to the manipulation states of the panel controls 6 and to conduct various settings of the electronic musical instrument (i.e. parameters for controlling music playing) and of the automatic music playing function. A step S3 conducts music playing processing, which will be described in detail herein later with reference to FIG. 4. In short, however, the music playing processing is to prefetch an automatic music playing data file, and to generate musical tone signals successively based on the prefetched automatic music playing data file. A step S4 is to produce musical tones according to the above generate musical tone signals, and to emit audible sounds from the sound system 10 including a loudspeaker. This main routine can present consecutive playing of different music pieces one after another successively.

Next, a description will be made about the panel setting processing included in the main routine. FIGS. 3*a* and 3*b* show, in combination, a flow chart describing an example of the panel setting processing, which is a subroutine of the step S2 in the main routine of FIG. 2. The panel setting processing is to make various settings of the apparatus according to the manipulation of the panel controls 6 on the electronic musical instrument.

A step S11 judges whether there is any input from the panel controls 6, namely any panel control is manipulated by the user. When there is no manipulation of the panel controls by the user, the judgment at the step S11 is negative (NO), and the processing of this subroutine comes to an end without making any setting to the electronic musical instrument, that is, the process flow returns to the main routine. On the other hand, in the case where there is any manipulation of the panel controls and the step S11 judges affirmative (YES), the process flow moves toward a step S12 and so forth to judge which of the panel controls is manipulated. The steps S12 through S15 are respectively to detect which panel controls 6 are operated.

When a panel control other than those related to the automatic music playing function, the step S12 judges negative (NO) and the process proceeds to a step S17 to conduct processing for commands other than the automatic music playing. The other commands may be those of setting a mode of prefetching (e.g. prefetch mode A or prefetch mode B, as described later), setting a chain play operation on the automatic music playing (the operation in which music pieces are automatically played one after another according to the order which is set by the user beforehand), setting a tone volume, setting a timbre, and so forth. In the case where one of the plural pedal controls are set to be used as a sequential call button to call registration files (which are currently assigned to registration call buttons) one after another sequentially and to fetch the next (in the predetermined order) set of registration data files from the storage device 4 to assign to the registration call buttons anew after the last one of the currently assigned registration files has been called (and is being used), the processing for sequentially calling the registration data files (among the currently assigned ones) and the processing for fetching and assigning the next set of registration data files anew are the processing conducted in the step S17. There may, of course, be provided a separate (i.e. dedicated) sequential call button. In the latter processing, the next (according to the predetermined order) set of registration data files are read out from the storage device 4 (corresponding to the first storage device) and are stored into the RAM 3 (corresponding to the second storage device). The former processing above is for the next registration call function, and a command whether to make such a function operative or not is also included in the other commands processed in the step S17. The next registration call function is a function in which the registration data files respectively assigned to the registration call buttons are called and used one after another in the predetermined order sequentially upon manipulation of the sequential call button (either a separate button or a so-assigned pedal control).

When the command from the operated control is related to the automatic music playing, the step S12 judges affirmative (YES), the process flow proceeds to a step S13. If the manipulated control is a music piece selection switch to select a piece of music, the step S13 judges affirmative (YES), and the process flow goes forward to a step S18 (FIG. 3*b*) to read out the music title (including other related items) data attached to the automatic music playing data file of the selected music piece from the storage device 4 or the ROM 2 (both being the first storage device) and to display the same on the display screen 7 (FIG. 1). Next, a step S19 accepts the choice of a music piece, wherein the user selects a desired one from among the listed music titles and the selected music piece is recognized by the system. A step S20 judges whether the automatic music playing data file of the accepted music piece is stored in the RAM 3 (corresponding to the second storage device). If the automatic music playing data file of the accepted music piece is already stored in the RAM 3, which means that the music piece has already been played or the date file has already been prefetched, the judgment at the step S20 is affirmative (YES), and the processing of this subroutine comes to an end, and the process flow returns to the main routine.

On the other hand, if the automatic music playing data file of the accepted music piece is not stored in the second storage device, the step S20 judges negative (NO), and the process moves forward to a step S21, which judges whether the second storage device has space available for storing further data. If the judgment at the step S21 is affirmative (YES), the process flow goes forward to a step S23 to read out the automatic music playing data file of the accepted music piece from the first storage device and store the same into the second storage device. If there is not enough space to store this automatic music playing data file in the second storage device, the step S21 judges negative (NO), the process flow goes to a step S22 to optimize the second storage device, by, for example, erasing some unnecessary data or rendering such data overwritable so that an available space is secured in the second storage device for the intended automatic music playing data file. Thereafter, in the step S23, the automatic music playing data file of the accepted music piece is read out from the first storage device and is stored in the second storage device.

In case the manipulated panel control is not the music piece selection switch, but a play start switch, the process proceeds to a step S14 and the step S14 judges affirmative (YES). Then, a step S24 sets a play-start flag before ending this panel setting processing to return to the main routine. In case the manipulated panel control is a play stop switch, the process proceeds to a step S15 and the step S15 judges affirmative (YES). Then, a step S25 cancels the play-start flag before ending this panel setting processing to return to the main routine. Where the manipulated panel control is the one related to the automatic music playing but other than those mentioned above, the process goes to a step S16 to conduct processing according to such other command. Such other commands includes a command to fast forward, to rewind and to do other operations relating to the playback of the music piece.

Next, a description will be made about the music playing processing included in the main routine. FIGS. 4*a* and 4*b* show, in combination, a flow chart describing an example of the music playing processing, which is a subroutine of the step S3 in the main routine of FIG. 2. The music playing processing is to play music based on the automatic music playing data file and to play music based on the manipulations of the music playing controls by the user.

First, a step S31 (FIG. 4*a*) judges whether the apparatus is in the automatic playing mode i.e. the automatic playing function is operating. Namely it judges whether the play-start flag is set in the panel setting processing in response to the manipulation of the play-start command switch. Where the play-start flag is not set, the step S31 judges negative (NO), and the process flow jumps to a step S42 (FIG. 4*b*) for the manual music playing. Where the play-start flag is set, the step S31 judges affirmative (YES), and the process goes to a step S32. The step S32 judges whether the automatic music playing data to be played back at the current time are stored in the second storage device. Where such automatic music playing data to be processed at the current time are already stored in the second storage device, the step S32 judges affirmative (YES), and the process flow goes to a step S33. The step S33 conducts tone generation data processing, i.e. generates musical tone signals based on the automatic music playing data. The generated musical tone signals are to be processed at the step S4 in the main routine of FIG. 2 for the production of audible musical sounds through the sound system 10 of FIG. 1.

A step S34 conducts preprocessing for the next registration data files to prefetch, from the first storage device, a set of registration data files to be assigned to the registration call buttons in the next sequence and store the same in the second storage device, where the next registration call operation is functioning. The details of the preprocessing at the step S34 will be described herein later with reference to a subroutine flow chart shown in FIG. 7. Next, a step S35 judges whether there are still some data remaining unprefetched in the first storage device and to be stored in the second storage device among the data in the automatic music playing data file of the currently playing music piece. In other words, the step S35 step judges whether the automatic music playing data file of the currently playing music piece is now in the midst of reading out from the first storage device and of writing into the second storage device, and this automatic music playing data file has not been completely written into the second storage device yet so that the remaining part of the data in the file are yet to be fetched and stored in the second storage device. If the judgment is affirmative (YES), the process flow goes to a step S36 to delete the past data from the second storage device. The past data in this context means the data of a whole automatic music playing data file of a music piece which was already played back in the past and also means the data of a part of the automatic music playing data file of the currently playing music piece which part has already been processed. By deleting such past data which have already been processed, a free space available for further data storage is secured in the second storage device. Then, a step S37 reads out, from the first storage device, the remaining part of the data of the automatic music playing data file of the currently paying music piece which part are not yet stored in the second storage device, and stores the same into the above secured free space of the second storage device.

A step S38 conducts processing for optimizing the second storage device by deleting further past data which need not be stored in the second storage device as they have already been processed, in addition to the processing mentioned in connection with the step S36. The details of the processing at the step S38 will be described herein later with reference to a subroutine flow chart shown in FIG. 5. Next, a step S39 conducts processing for determining an automatic music playing data file to be prefetched and stored in the second storage device other than the automatic music playing data file of the currently playing music piece. The details of the processing at the step S39 will be described herein later with reference to a subroutine flow chart shown in FIG. 6. Next, a step S40 (FIG. 4*b*) judges whether the second storage device has an available space. If there is a free space in the second storage device which already stores the automatic music playing data file of the currently playing music piece, the step S40 judges affirmative (YES), and the process flow goes to a step S41. The step S41 is to read out the above determined automatic music playing data file from the first storage device and to store the same into the second storage device.

Then, the process flow proceeds to a step S42. This step is reached also when the apparatus is not operating in the automatic music playing mode and the step S31 (FIG. 4*a*) judges negative (NO). The step S42 judges whether any of the controls 5 and 6 is manipulated. If the judgment is negative (NO), the processing of this subroutine comes to an end. If the judgment is affirmative (YES), the process flow goes to a step S43. In case the detected event of the manipulated control is a key-on in the music playing keyboard 5, the step S43 judges affirmative (YES) and the process flow goes forward to a step S45. The step S45 generates the tone data of the note named by the manipulated (i.e. depressed) key. In case the detected event of the manipulated control is a key-off in the music playing keyboard 5, the step S43 judges negative (NO) and a step S44 judges affirmative (YES), and the process goes forward to a step S46. The step S46 extinguishes the tone data of the note named by the manipulated (i.e. released) key. In case the manipulated control is the one in the panel controls 6, both the steps S43 and S44 judge negative (NO), and the process flow goes to a step S47. The step S47 conducts the process of setting the registration and thereafter a step S48 conducts the processing for other controls. The processing at the step S47 includes the processing of switching over the registrations, when the user presses any of the registration call buttons or the sequential call button. The details of the processing at the step S47 will be described herein later with reference to a subroutine flow chart shown in FIG. 8.

Next, a description will be made about the processing of optimizing the second storage device as conducted by the step S22 in the panel setting processing of FIGS. 3*a* and 3*b* and by the step S38 in the music playing processing of FIGS. 4*a* and 4*b*. FIG. 5 shows a flow chart describing an example of the subroutine processing of optimizing the second storage device.

A step S51 judges whether there are some data or data files among the automatic music playing data files stored in the second storage device which were prefetched but not used in the past. In case that there are such unused automatic music playing data or data files and that a predetermined time has lapsed since such data or data files were stored, the step S51 and a step S52 both judge affirmative (YES) and then a step S53 deletes such unused data or data files from the second storage device. Next, a step S54 judges whether there are some data or data files among the automatic music playing data files stored in the second storage device which have rarely been used (i.e. less frequently used) for the automatic music playing in the past. In case that there are such low-usage data or data files and that a predetermined time has lapsed since such data or data files were stored, the step S54 and a step S55 both judge affirmative (YES) and then a step S56 deletes such low-usage data or data files from the second storage device. Then, the process flow returns to the original routine.

Figure 6:
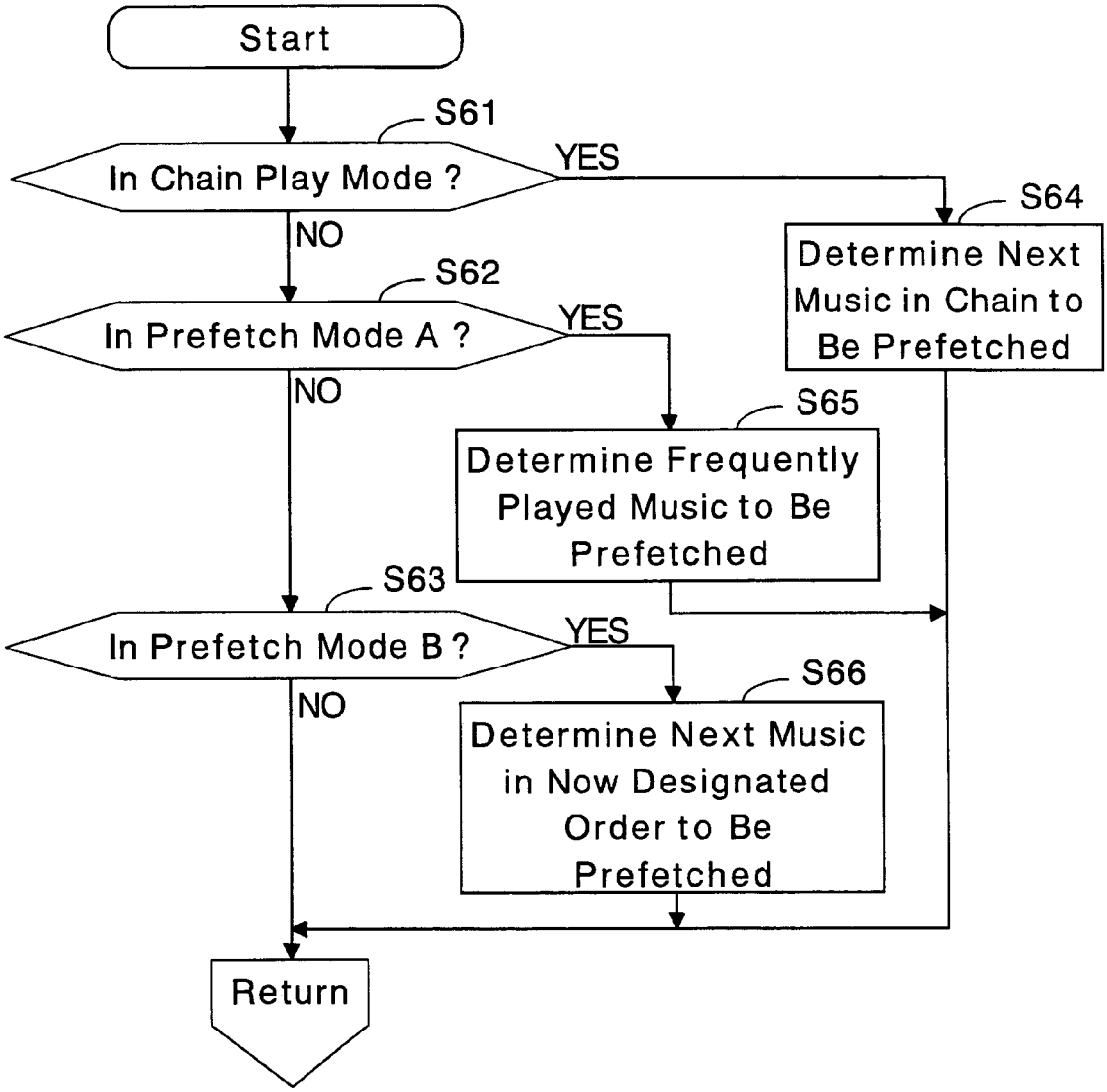
FIG. 6 is a flow chart describing an example of the process for determining the data to be prefetched.

Next, a description will be made about the processing of determining the data to be prefetched as conducted by the step S39 in the music playing processing of FIGS. 4*a* and 4*b*. FIG. 6 shows a flow chart describing an example of the subroutine processing of determining the data to be prefetched.

A step S61 judges whether the automatic music playing apparatus is operating in the chain play mode, namely, the apparatus is conducting the automatic music playing operation to play music pieces successively one after another in the order set by the user. Where the apparatus is operating in the chain play mode, the step S61 judges affirmative (YES) and the process flow goes to a step S64. The step S64 determines the automatic music playing data file of the music piece next to the current music piece in the order previously set by the user, as the data file to be prefetched next. If the apparatus is not in the chain play mode, the step S61 judges negative (NO), the process flow proceeds to a step S62. The step S62 judges whether the apparatus is set to be in a prefetch mode A. If the judgment is affirmative (YES), the process flow goes to a step S65, and the step S65 determines a frequently played music piece as an object automatic music playing data file to be prefetched. On the other hand, if the apparatus is set to be in a prefetch mode B, a step S63 judges whether the apparatus is set to be in a prefetch mode B. If the step S63 judges affirmative (YES), the process flow goes to a step S66 and the step S66 determines the automatic music playing data file of the music piece which comes next to the currently played music piece in some predetermined default order such as the order of categories, as the data file to be prefetched next.

Next, a description will be made about the preprocessing for the next registration data files as conducted by the step S34 in the music playing processing of FIGS. 4*a* and 4*b*. FIG. 7 shows a flow chart describing an example of the subroutine process of preprocessing for the next registration data files. The preprocessing for the next registration data files is to prefetch, from the first storage device, a set of registration data files to be assigned to the registration call buttons in the next sequence, and to store the same in the second storage device, where the next registration call operation is functioning.

A step S71 judges whether the next registration call function is set. That is the function in which the registrations respectively assigned to the registration call buttons are called sequentially one after another by each manipulation of the registration sequential call button so that the called registration is used for or applied to the music playing. Such a function is conducted at the step S17 shown in FIG. 3. The sequential call button may be a dedicated button separately provided for this particular purpose, or may be one of the plurality of pedal controls to which the sequential call function is assigned by the user's setting. Where the next registration call function is set, the step S71 judges affirmative (YES) and the process flow proceeds to a step S72. The step S72 judges whether the whole of the next set of registration data files are already fetched and stored in the second storage device. When the judgment at the step S72 is negative (NO), the process flow further proceeds to a step S73 to fetch the whole of the next set of registration data files and store the same into the second storage device. By loading the next set of registration data files into the second storage device beforehand, an immediate call of a registration contained in the next set of registrations to be assigned to the registration call buttons is possible according to the user's manipulation of the sequential call button. Thus, intended registrations can be called and used in response to the user's commands without delay.

Next, a description will be made about the processing of setting the registration as conducted by the step S47 in the music playing processing of FIGS. 4*a* and 4*b*. FIG. 8 shows a flow chart describing an example of the subroutine process of setting the registration. The processing of setting the registration is to switch over the registrations and select a desired registration, when the user presses any of the registration call buttons or the sequential call button.

A step S81 judges whether a registration-related control is operated, namely, any of the registration call buttons or the sequential call button (or the so-assigned pedal control) is manipulated. If the judgment is affirmative (YES), the process flow goes to a step S82, which in turn judges whether the operated control is a registration call button. In case the registration call button is manipulated, a step S83 changes the apparatus setting according to the registration which is assigned to the operated registration call button. In case the sequential call button is manipulated, a step S84 judges affirmative (YES), and a step S85 changes the apparatus setting according to the next registration which is set to be called next to the currently used registration according to the order set by the user (or by default) beforehand. If the apparatus is set according to the last registration among the set of registrations currently assigned to the registration call buttons, a step S86 assigns the next set of registration data files prefetched and stored in the second storage device to the registration call buttons, deleting the same set of registration data files from the second storage device thereafter. When the step S84 judges negative (NO), a step S87 conducts processing for other commands. An example of processing for other commands is the case like this. As the registration includes the parameters about the rhythm kind and the tempo, a change from one registration to another would change the rhythm kind or the tempo, and consequently the music playing under the same (unchanged) rhythm and tempo might not be maintained, when the registrations are changed. To obviate such an inconvenience, a disabling button may be provided to disable the change in rhythm and tempo while the voices are changed according to the registration change. For example, with the disabling button set on, the rhythm, the tempo, the volume, the reverberation effect, etc. can be kept unchanged, even when the registrations are switched over from one to another.

In the present invention, one of the pedal controls may be employed as a gang assignment button for reading out a set of registration data files from among plural sets of registration data files in the predetermined order and assigning respectively to the registration call buttons. Then, the user can command the gang assignment of plural registrations to the plural registration call buttons in the predetermined order by every simple manipulation of the so-employed pedal control.

While one automatic music playing data file or one set of registration data files is prefetched and stored in the second storage device in the above described embodiment, the number of such prefetched files or sets may not necessarily be limited to one, but may be two or more. For example, a plurality of automatic music playing data files to be played back next and so forth may be prefetched and stored in the second storage device. Similarly, a plurality of sets of registration data files to be assigned to the registration call buttons and used next and so forth may be prefetched and stored in the second storage device. Although the first storage device is typically an external storage device and the second storage device is a RAM in the above described embodiment, the first and second storage devices may be a first and second storage areas separately provided on a same storage device.

The automatic music playing data may be of any form, for example, a digital coded form such as the SMF (standard MIDI file), or a waveform sample form such as a PCM (pulse code modulation) form, a DPCM (differential pulse code modulation) form and an ADPCM (adaptive differential pulse code modulation) form. Further, the data format of the automatic music playing data may be of any type such as an "absolute time+event" type which represents the time point of an event by an absolute time position from the top of the music piece or the top of each measure, a "relative time+event" type which represents the time point of an event by a time lapse from the preceding event, a "note pitch (rest)+duration" type which represents the progression of music by aligning notes, each defined by the pitch and the duration, and rests, each defined by the duration (no pitch), and a "direct memory mapping" type in which memory regions are secured (allotted) for all the available time points under the minimum resolution of time progression for the music and each performance event is written at a memory region which is allotted to the time point of such each event.

Where the automatic music playing data file contains music playing data of plural music performance channels, the data of the plural channels may be intermingled on one track or the data of the respective channels may be separately recorded on separate tracks. The data processing of the automatic music playing data in the automatic music playing mode may be in various manners, such as a manner in which the processing periods are variable according to the tempo set for the automatic music playing and a manner in which the processing periods are constant but the counting rate of the time data in the music playing data to be processed at a time is altered according to the tempo. Various processing manners may be applicable.

As will be apparent from the above description, according to the present invention, dead time between the adjacent pieces of automatically played music and delay in effectuating the registrations will be avoided.

While particular embodiments of the invention and particular modifications have been described, it will, of course, be understood by those skilled in the art that various modifications and substitutions may be made without departing from the spirit of the present invention so that the invention is not limited thereto, since further modifications may be made by those skilled in the art, particularly in light of the foregoing teachings. It is therefore contemplated by the appended claims to cover any such modifications that incorporate those features of these improvements in the true spirit and scope of the invention.

What is claimed is:

1. An automatic music playing apparatus comprising:

a first storage device, equipped with an external storage medium, that stores a plurality of automatic music playing data files each containing automatic music playing data associated with a music piece;

an internal second storage device;

a transfer device that fetches one of the automatic music playing data files from said first storage device and transfers the fetched automatic music playing data file to said second storage device;

manual music playing controls that are manipulable by a user for manual music playing;

a music playing processing device that reads out from said second storage device the fetched one automatic music playing data file as a current automatic music playing data file to be subject to automatic music playing processing, conducts automatic music playing processing according to said current automatic music playing data file to play the music piece associated with the current automatic music playing data file, and conducts manual music playing processing based on the manipulation of said manual music playing controls; and a transfer controlling device that controls said transfer device to prefetch from said first storage device another one of the automatic music playing data file associated with another music piece to be processed next, and to transfer the another automatic music playing data file to processed next to said second storage device, while said music playing processing device is conducting automatic music playing processing to play the music piece associated with said current automatic music playing data file.

2. The apparatus as claimed in claim 1, further comprising an automatic music playing mode setting device that sets a mode in which said music playing processing device conducts said automatic music playing processing.

3. The apparatus as claimed in claim 2, wherein said mode determines the another music playing data file to be processed next from among the automatic music playing data files that have been used in playing music most frequently in the past among said automatic music playing data files stored in said first storage device.

4. The apparatus as claimed in claim 2, wherein said mode determines the another music playing data file to be processed next from among said automatic music playing data files stored in said first storage device according to a predetermined default order.

5. The apparatus as claimed in claim 2, wherein said mode determines the another music playing data file to be stored in said second storage device based on an order set by a user.

6. A music playing apparatus comprising:

a plurality of registration call devices;

a first storage device, equipped with an external storage medium, that stores a plurality of registration data files each defining a set of parameters for a musical performance conducted by said music playing apparatus;

an internal second storage device;

a transfer device that fetches a set of registration data files from said first storage device and transfers the fetched set of registration data files to said second storage device;

a registration assignment device that assigns said fetched set of registration data files in said second storage device respectively to said registration call devices;

a music playing processing device that reads out from said second storage device one of the registration data files assigned to one of said plurality of registration call devices in response to manipulation of the one registration call device, sets the parameters for music playing, and conducts music playing processing based on said set parameters; and a transfer controlling device that controls said transfer device to read out from said first storage device another one of the registration data files that is different from the previously fetched set of registration data files respectively assigned to said plurality of registration call devices, and to transfer the another registration data file to said second storage device, while said plurality of registration call devices are assigned with the respective registration data files.

7. A music playing apparatus comprising:

a plurality of registration call devices;

a first storage device, equipped with an external storage medium, that stores a plurality of registration data files each defining a set of parameters for music playing conducted by said music playing apparatus;

an internal second storage device;

a transfer device that fetches a set of registration data files from said first storage device and transfers the fetched set of registration data files to said second storage device;

a registration assignment device that assigns said fetched set of registration data files in said second storage device respectively to said registration call devices;

a sequential call device;

a music playing processing device that calls said plurality of registration call devices one at a time in a predetermined order of sequence to read out from said second storage device the registration data file assigned to the called one of said plurality of registration call devices upon manipulation of said sequential call device, sets the parameters for music playing according to said registration data file assigned to the called one registration call device, and conducts music playing processing based on said set parameters; and a transfer controlling device that controls said transfer device to read out from said first storage device another one of the registration data files that is different from the previously fetched set of registration data files respectively assigned to said plurality of registration call devices, and to transfer the another registration data file to said second storage device, while said plurality of registration call devices are assigned with respective registration data files.

8. The apparatus as claimed in claim 7, wherein said sequential call device is a foot-operated device.

9. A computer-readable storage medium storing a computer program for playing music automatically with an automatic music accompaniment apparatus having a first storage device equipped with an external storage medium, an internal second storage device, and manual music controls manipulable by a user for manual music playing, said program containing instructions for:

storing a plurality of automatic music playing data files, each containing automatic music playing data associated with a music piece, in said first storage device;

fetching one of the automatic music playing data files from said first storage device and storing the fetched one automatic music playing data file in said second storage device;

reading out from said second storage device the fetched one automatic music playing data file as a current automatic music data file to be subject to automatic music playing processing;

conducting automatic music playing processing according to said current automatic music playing data file to play the music piece associated with the current automatic music playing data file;

conducting manual music playing processing based on the manipulation of said manual music playing controls; and prefetching from said first storage device another one of the automatic music playing data file associated with another music piece to be processed next, and storing the another automatic music playing data file to be processed next in said second storage device, while conducting automatic music playing processing to play the music piece associated with the current automatic music playing file.

10. A computer-readable storage medium storing a program for playing music with an automatic music playing apparatus having a first storage device equipped with an external storage medium, an internal second storage device, a plurality of registration call devices, and a sequential call device, said program containing instructions for:

storing a plurality of registration data files in said first storage device, each registration data file defining a set of parameters that determine the conditions for playing music;

fetching a set of registration data files from said first storage device and storing the fetched set of registration data files in said second storage device;

assigning said fetched set of registration data files in said second storage device respectively to said registration call devices;

reading out from said second storage device the registration data file assigned to one of said plurality of registration call devices in response to manipulation of the one registration call device;

setting the parameters for music playing;

conducting music playing processing based on said set parameters; and prefetching from said first storage device another one of the registration data files that is different from the previously fetched set of registration data files respectively assigned to said plurality of registration call devices, and storing the another registration data file in said second storage device, while said plurality of registration call devices are assigned with the respective previously fetched registration data files.

11. A computer-readable storage medium storing a computer program for playing music with an automatic music playing apparatus having a first storage device equipped with an external storage medium, an internal second storage device, a plurality of registration call devices, and a sequential call device, said program containing instructions for:

storing a plurality of registration data files in said first storage device, each registration data file defining a set of parameters that determine the conditions for playing music;

fetching a set of registration data files from said first storage device and storing said fetched set of registration data files in said second storage device;

assigning the fetched set of registration data files in said second storage device respectively to said registration call devices;

calling said plurality of registration call devices one at a time in a predetermined order of sequence to read out from said second storage device the registration data file assigned to the called one of said plurality of registration call devices upon manipulation of said sequential call device;

setting the parameters for music playing according to said registration data file assigned to the called one registration call device;

conducting music playing processing based on said set parameters; and prefetching from said first storage device another one of the registration data files that is different from the previously fetched set of registration data files respectively assigned to said plurality of registration call devices, and storing the another registration data file in said second storage device, while said plurality of registration call devices are assigned with the respective previously fetched registration data files.

* * * * *